US005950378A

United States Patent [19]

Council et al.

[11] Patent Number: 5,950,378

[45] Date of Patent: Sep. 14, 1999

[54] COMPOSITE MODULAR FLOOR TILE

[76] Inventors: Walter S. Council, 1121-203 Parkridge La., Raleigh, N.C. 27606; Jimmy L. Adams, Jr., 5462 Pine Top Cr., Raleigh, N.C. 27612

[21] Appl. No.: 08/995,604

[22] Filed: Dec. 22, 1997

[51] Int. Cl.[6] ..... E04F 11/16

[52] U.S. Cl. ..... 52/177; 52/180; 52/392; 52/403.1; 52/480

[58] Field of Search ..... 52/177, 180, 181, 52/403.1, 480, 386, 392

[56] References Cited

U.S. PATENT DOCUMENTS

| | | | |
|---|---|---|---|
| 4,008,548 | 2/1977 | Leclerc | 52/180 |
| 4,226,064 | 10/1980 | Kraayenhof | 52/180 |
| 4,361,614 | 11/1982 | Moffitt, Jr. | 428/138 |
| 4,436,779 | 3/1984 | Menconi et al. | 428/169 |
| 4,584,221 | 4/1986 | Kung | 428/44 |
| 4,860,510 | 8/1989 | Kotler | 52/177 |
| 4,930,286 | 6/1990 | Kotler | 52/177 |
| 5,628,160 | 5/1997 | Küng | 52/591.1 |
| 5,761,867 | 6/1998 | Carling | 52/386 |
| 5,787,654 | 8/1998 | Drost | 52/177 |

*Primary Examiner*—Christopher T. Kent
*Assistant Examiner*—Yvonne Horton-Richardson
*Attorney, Agent, or Firm*—Coats & Bennett, PLLC

[57] ABSTRACT

A modular floor tile has a two piece construction including a top member and a support member. The top member is made of a relatively hard material that is resistant to scuffing and which accepts paints. The support member is made of a resilient, impact-absorbing material and is secured to the underside of the top member. The material of the support member is selected to give the desired impact-absorbing characteristics. In a preferred embodiment, a plurality of support nodes extend downward from a bottom surface of the support member. The support nodes are spaced from one another so as to define an air circulation space between the bottom surface of the support member and the underlying support surface. The modular floor tiles also include interlocking members for interlocking adjacent tiles with one another.

30 Claims, 7 Drawing Sheets

COMPOSITE MODULAR FLOOR TILE

FIELD OF THE INVENTION

This invention relates generally to modular floors systems, and more particularly, to a molded thermoplastic tile used to construct athletic playing surfaces such as basketball courts and tennis courts.

BACKGROUND OF THE INVENTION

Modular thermoplastic floor tiles have been developed for use as athletic playing surfaces. In general, modular thermoplastic floor systems are less expensive to install and maintain than most conventional athletic surfaces, such as hardwood floors. Additionally, modular thermoplastic tiles have many beneficial properties which make them suitable for athletic playing surfaces. For example, thermoplastic floor tiles have good impact absorption properties which reduce the risk of injury to players. For these reasons, modular thermoplastic floor systems are steadily gaining popularity.

Examples of modular floor tiles are disclosed in the patents to Kotler, U.S. Pat. Nos. 4,930,286 and 4,860,510; Menconi et al., U.S. Pat. No. 4,436,779; and Forlenza, U.S. Pat. No. 4,054,987. Modular floor tiles are also shown in two design patents to Swanson et al., U.S. Pat. No. Des. 274,948 and U.S. Pat. No. Des. 274,588. Each of the aforementioned patents discloses a modular thermoplastic tile for athletic playing surfaces. These prior art tiles comprise a rectangular support grid composed of intersecting cross members and interlocking members for interlocking adjacent tiles. A common form of interlocking member used in prior art floor tiles comprises a series of coupling loops projecting from two sides of the support grid which are engaged by posts formed along the remaining two sides of the support grid.

While modular thermoplastic tiles make an excellent playing surface for athletics, there are nevertheless some minor problems. One problem is that painted lines on the surface of the tile do not adhere very well. Over time, the painted lines may peel or rub-off. Another problem is that the top surface of the floor tile becomes scuffed, thus detracting from the appearance of the tile. Scuffing, however, does not effect the performance of the tile.

Some attempts have been made in the past to solve the aforementioned problems by using different materials to make the tiles. Unfortunately, there are few, if any, materials which can meet all of the requirements. For example, materials which are resistant to scuffing or which accept paints well generally lack the impact absorption and friction characteristics needed for the tiles. Therefore, there is a need for a new design for a modular tile which retains the good impact absorption and friction characteristics of tiles currently being manufactured but which is more resistant to scuffing and which accepts painted lines more readily.

SUMMARY OF THE INVENTION

The present invention is a modular floor tile for constructing an athletic playing surface which overcomes some of the aforementioned problems with the prior art. The modular floor tile is a composite construction including a top member and a support member. The top member and support members are preferably constructed from two different materials. The top member is made of a relatively hard material which will be resistant to scuffing and which can readily accept paint. The bottom member is made of a resilient, impact-absorbing material such as a natural or synthetic rubber. The top member and support member are formed separately by injection molding and then subsequently bonded by a suitable adhesive material.

In a preferred embodiment of the invention, the top member includes a sidewall with a plurality of alternating projections and recesses. The projections and recesses on two of the sidewalls mate with the projections and recesses on the other two sidewalls. First and second interlock members are formed on each tile for interlocking the adjacent tiles together. The first interlock members comprise a series of coupling loops which are located in the recesses along two of the sidewalls. The second interlock members comprise posts which are formed on the projections along the other two sides. The posts on one tile engage in the coupling loops of an adjacent tile to interlock the tiles with one another.

Also, in a preferred embodiment of the invention, the support member has a generally flat bottom surface and a plurality of spaced-apart support nodes extending downward from the bottom surface. The support nodes maintain the bottom surface of the support member in an elevated position relative to the underlying support surface to define an air circulation space between the bottom surface and the underlying support surface. Air can freely circulate between the support nodes within the air circulation space.

The present invention may also have other advantageous properties which will be apparent to those of ordinary skill in the art from the foregoing description.

DETAILED DESCRIPTION OF THE INVENTION

Figure 1:
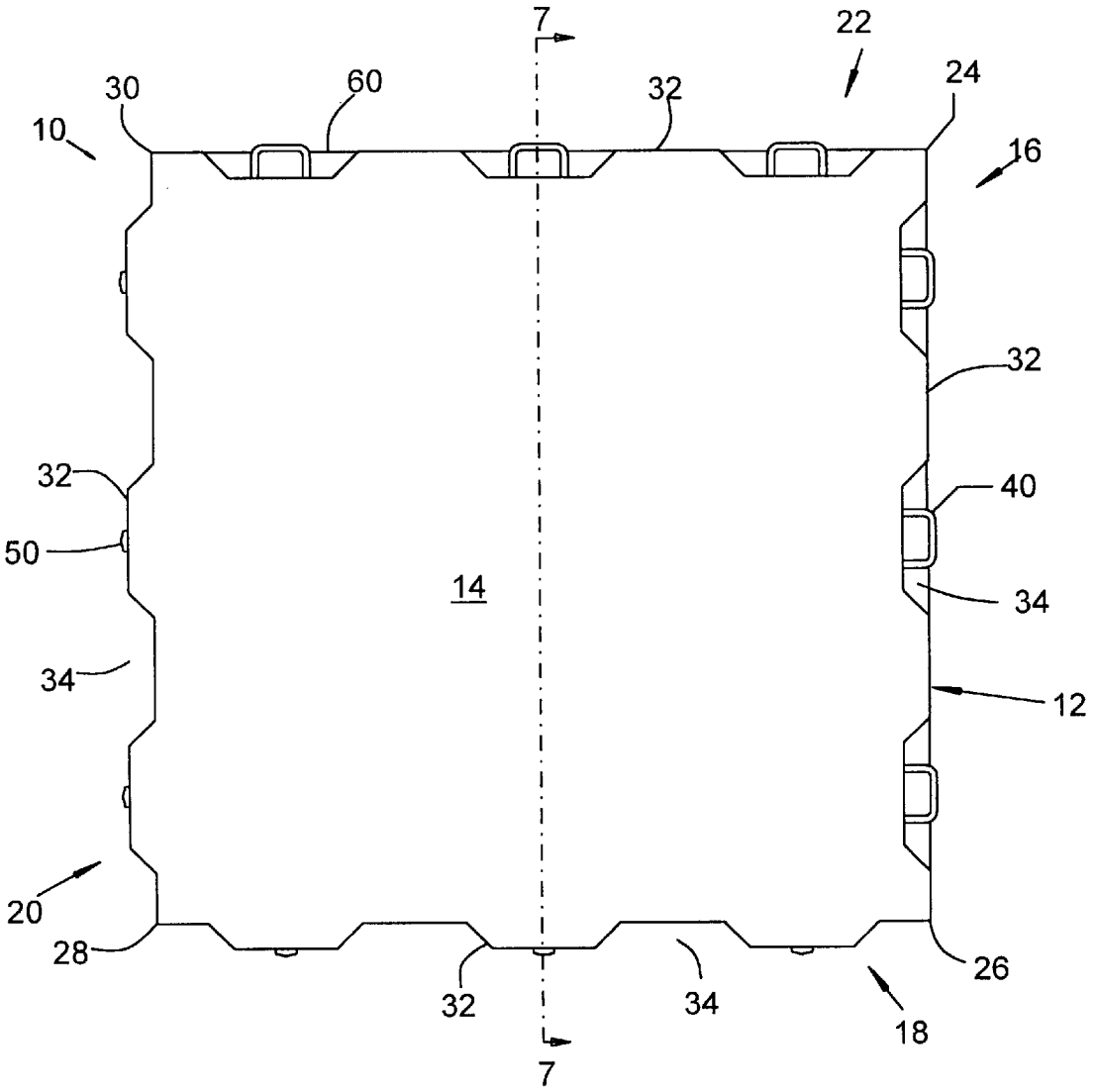
FIG. 1 is a top plan view of the modular floor tile of the present invention.

Referring now to the drawings, the modular tile of the present invention is shown therein and indicated generally by the numeral 10. Each module or tile 10 comprises two pieces—a top member 12 and a support member 60. The top member 12 is injection molded from a synthetic material such as PVC, polyester, or nylon. The support member 60 is injection molded from a rubber such as a urethane rubber. The top member 12 and support member 60 are molded separately and then bonded to form a unitary construction. Each tile 10 has a generally rectangular configuration and is designed to join with other like tiles 10 to form a continuous, uninterrupted playing surface.

Figure 2:
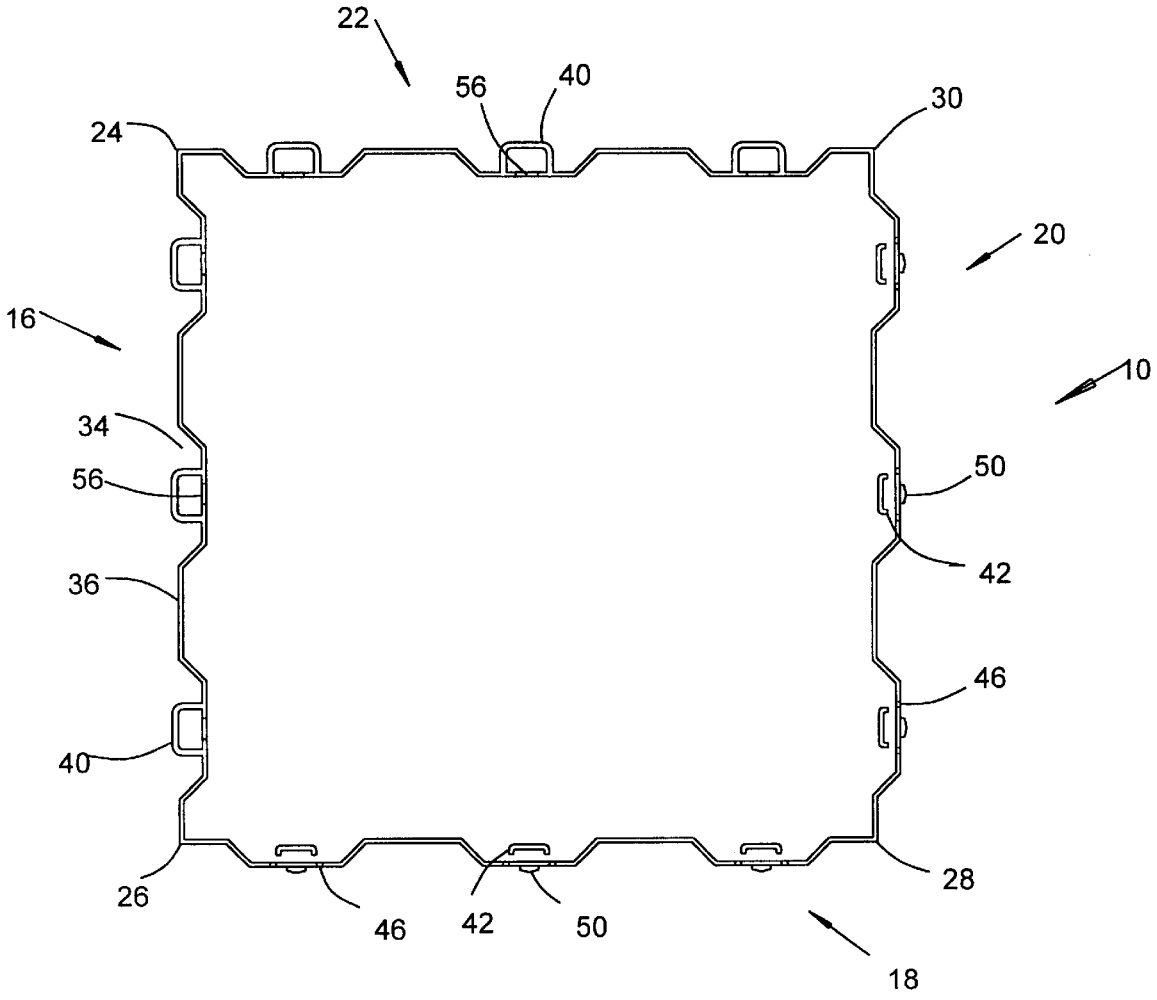
FIG. 2 is a bottom plan view of the modular floor tile without the support member.

Referring now to FIGS. 1 and 2, the top member 12 is shown. The top member 12 includes a top surface 14 and four sidewalls 16,18,20 and 22 which meet at corners 24, 26, 28 and 30. Each sidewall 16, 18, 20, 22 includes a series of alternating projections 32 and recesses 34. The projections 32 on sidewalls 18, 20 extend outward from the square defined by the four corners of the tile 10. On the remaining two sidewalls 16, 22, the recesses 34 extend inward from the side of the square defined by the four corners of the tile 10. It will be readily apparent therefore that the configuration of the sidewalls 18, 20 complements the configuration of the sidewalls 16, 22 so that the projections 32 on sidewalls 16, 22 mate with the recesses 34 on sidewalls 18,20, and vice versa.

Figure 3:
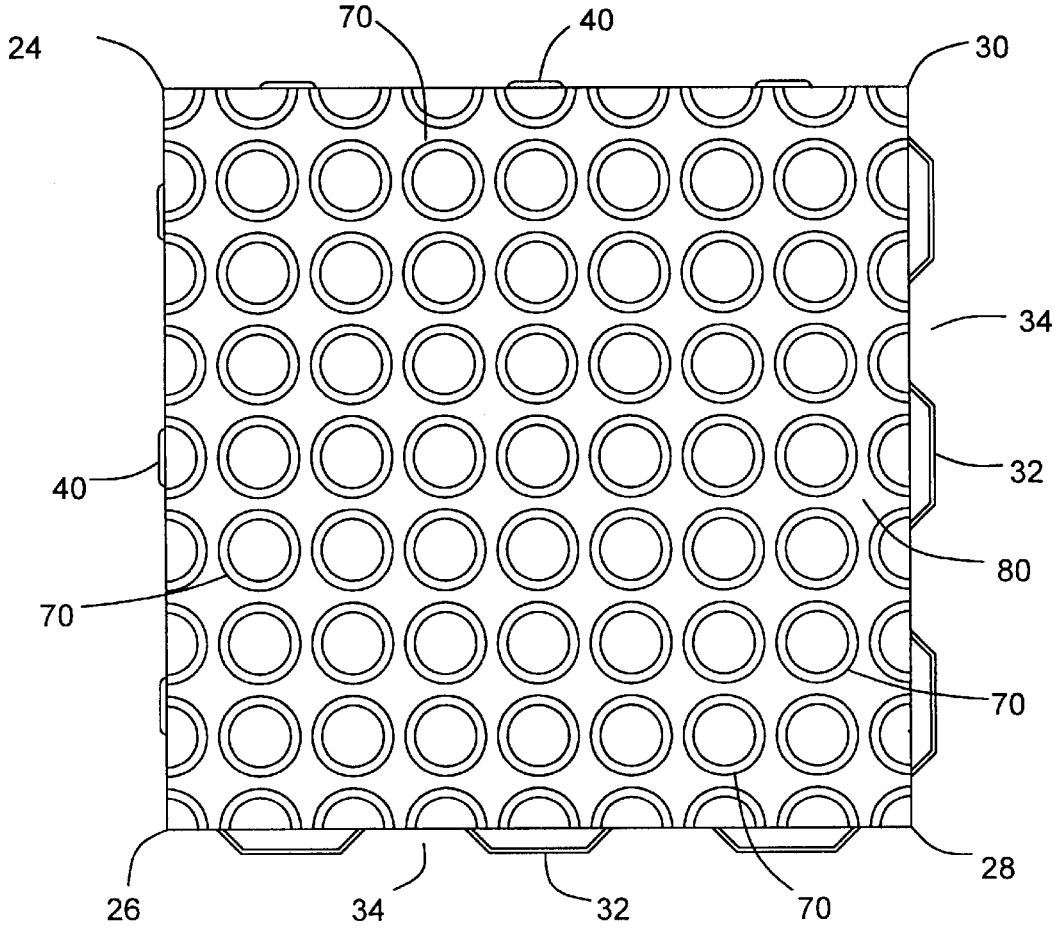
FIG. 3 is a bottom plan view of the modular floor tile with the support member.
Figure 4:
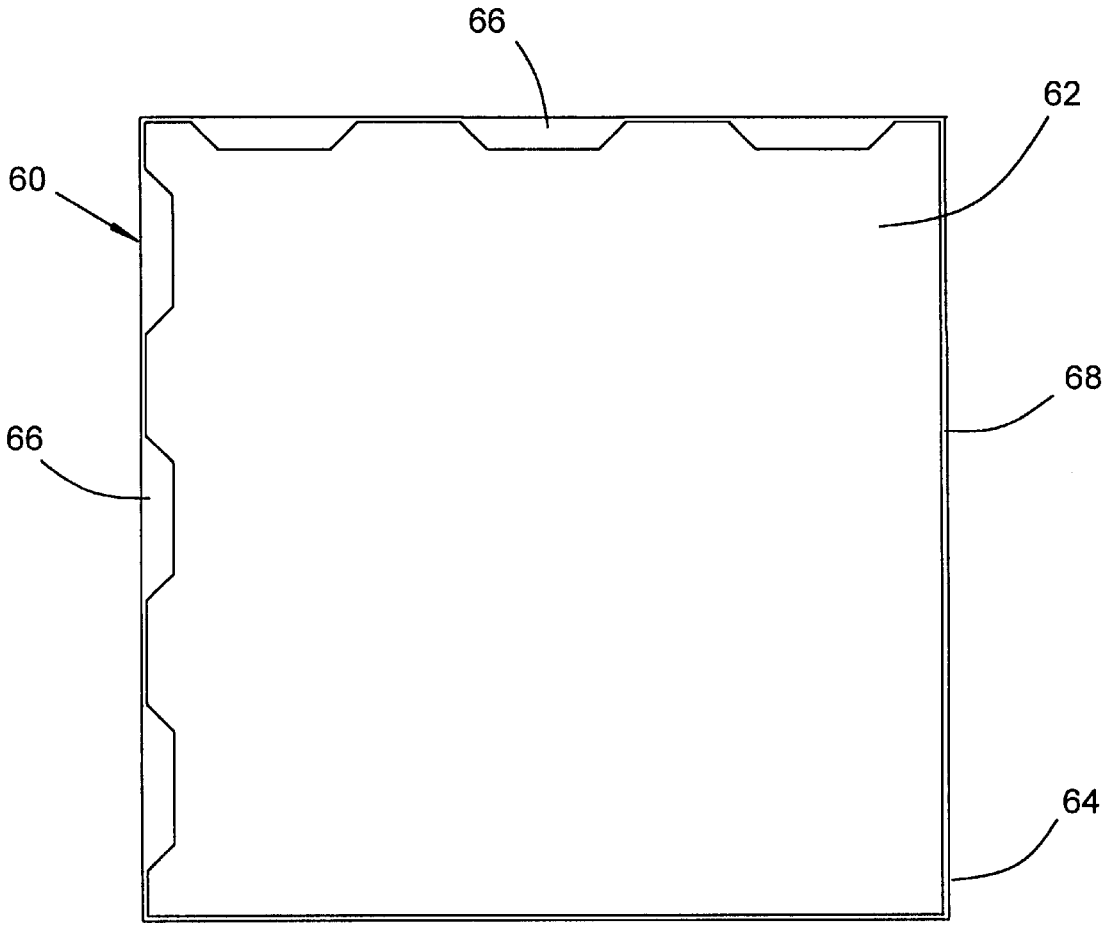
FIG. 4 is a top plan view of the top member.
Figure 5:
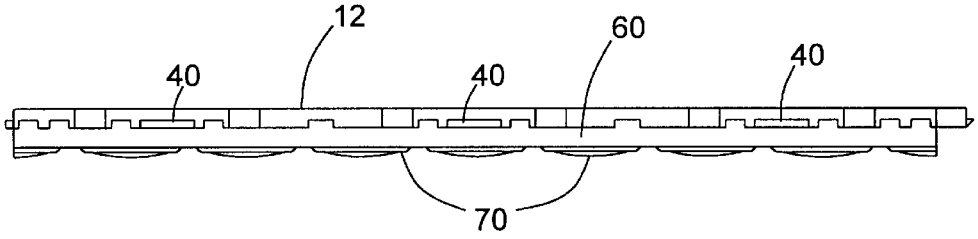
FIG. 5 is an elevation view of the floor tile.
Figure 6:
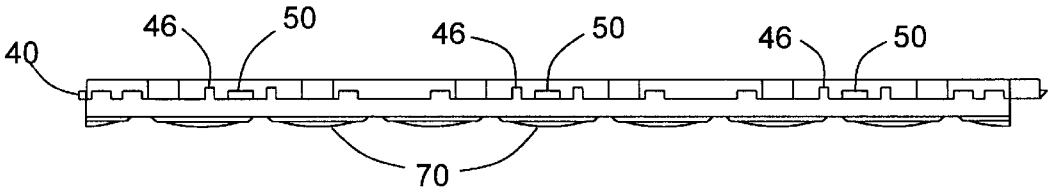
FIG. 6 is an another elevation view of the floor tile.
Figure 7:
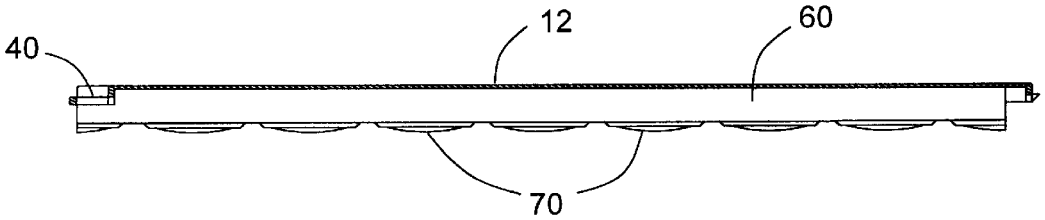
FIG. 7 is a section view taken along line 7—7 of FIG. 1.

FIGS. 3 and 4 show the support member 60. The support member 60 is a single piece of natural or synthetic rubber formed preferably by an injection molding process. The support member 60 is approximately twice the thickness of the top member 12. The support member 60 includes a top portion 62 and a bottom portion 64. The bottom portion is slightly larger than the top portion 62 so as to define a small ledge 68 that surrounds the top portion 62. The top portion 62 is sized and shaped to fit snugly into the top member 12 and includes a series of recesses 66 which correspond in form and position to the recesses 34 on sides 16,22 of the top member 12. When the top portion 62 of the support member 60 is inserted into the top member 12, the bottom portion 64 of the support member 60 extends below the bottom edge of the side walls of the top member 12 as seen in FIGS. 5–7. The sidewalls of the top member 12 seat against the ledge 68 that surrounds the top portion 62 of the support member 60. Thus, the bottom portion 64 of the support member 60 extends beneath the sidewalls of the top member 12. Preferaby, the bottom portion 64 of the support member 60 is flush with the sidewalls of the top member 12. Also, it should be noted that the the bottom portion 64 of the support member 60 extends below the coupling loops 40 on sides 16, 22 of the top member 12.

Figure 10:
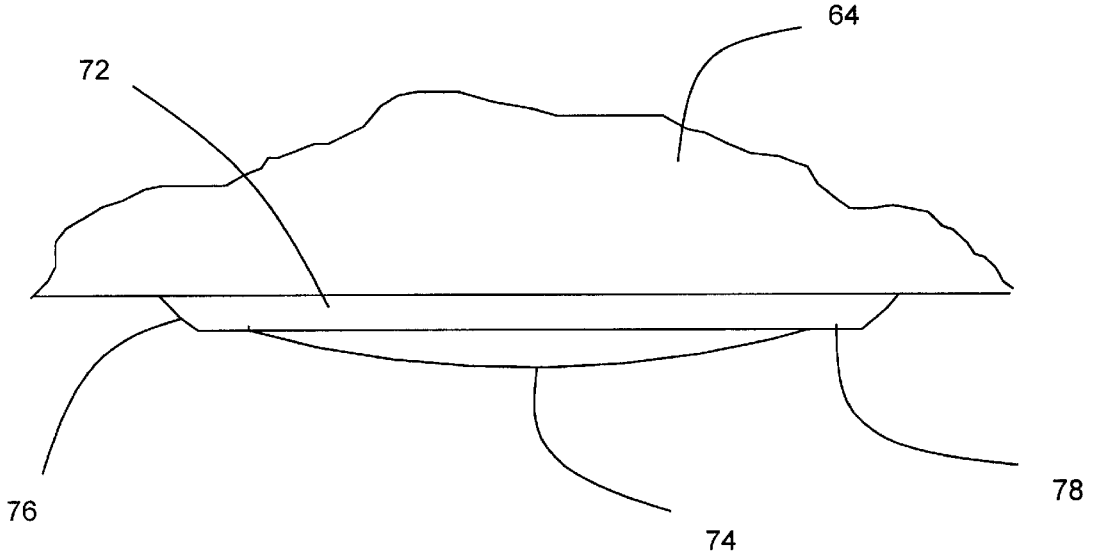
FIG. 10 is a side elevation view of a support node.

A plurality of support nodes 70 are formed on the bottom surface of the support member 60 (see FIG. 3). The support nodes 70 are shown in detail in FIG. 10. Each support node 70 has a tiered configuration that includes a relatively large base portion 72 and a relatively smaller ground-engaging portion 74. The base portion 72 includes a curved outer wall 76 and a flat land 78 which surrounds the ground-engaging portion 74. The ground-engaging portion 74 has a generally spherical form and projects downward from the land 80 on the base portion 72 of the support node 70. In the preferred embodiment of the invention, the ground-engaging portion 74 and the base portion 72 of the support node 70 are concentric when viewed from below.

The support nodes 70 engage the ground when the tiles 10 are installed and elevate the bottom surface of the support member 60 relative to the ground. This elevation of the support member 60 is important because it allows air to circulate between the support nodes 70 beneath the tile 10. The air circulation in turn prevents water-damage to the underlying support surface.

The tiered configuration of the support nodes 10 provides increased support when the tile 10 is subjected to large loads. When relatively light loads are imposed on the tile 10, the ground-engaging nodes 74 compress to absorb the load. When heavier loads are experienced, the ground-engaging portion 74 becomes compressed to such an extent that the base portion 72 of the support nodes 70 engages the ground providing increased support.

The support member 60, as previously mentioned, is separately formed from the top member 12. After the support member 60 is formed, it is bonded to the top member 12 by any suitable adhesive to form a unitary construction. The adhesive selected should preferably be non-soluble in water.

Figure 11:
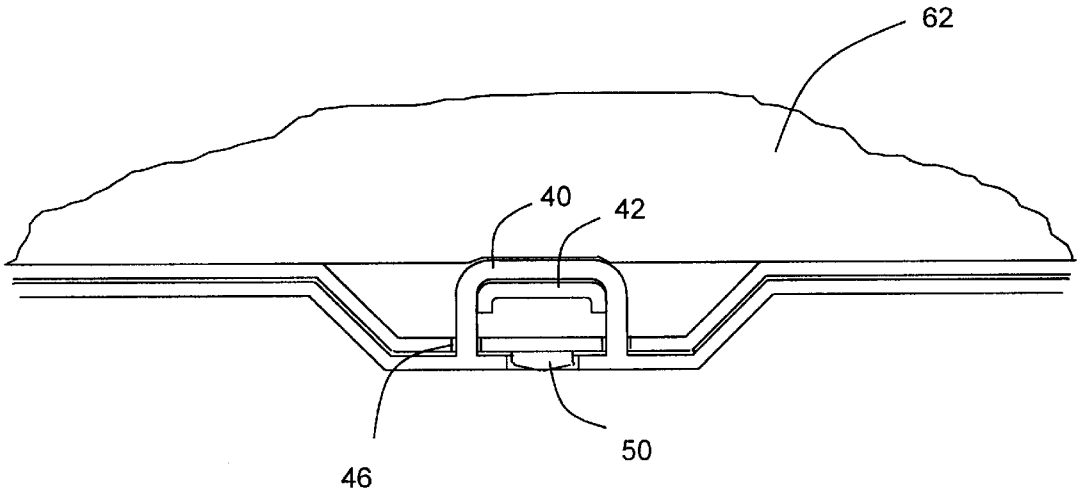
FIG. 11 is a detail view showing the interlocking mechanism used to join two tiles together.

For the purpose of interconnecting the tile 10 with similar tiles, each edge of the tile 10 is provided with an interlocking member. In the disclosed embodiment, the interlocking members consist of a series of coupling loops 40 located along two sides of the tile 10, and a series of posts 42 located along the other two edges of the tile 10. The posts 42 are shown in FIG. 2. The coupling loops 40 are integrally formed with the sidewalls of the tile 10 while the posts 42 are integrally formed and extend downward from the underside of the top surface 14. Adjacent tiles 10 are joined by interlocking the posts 42 from one tile 10 within the coupling loops 40 on an adjacent tile as shown in FIG. 11. It should be noted that when the coupling loop 40 and the posts 42 are interlocked, the top portion 62 of the support member presses against the outer end of the loop 40 to help seat the coupling loop 40 around the post 42.

In the disclosed embodiment, the coupling loops 40 are located in the recesses 34 along sidewalls 16, 22 (see FIGS. 1 and 5). The posts 42 are located adjacent the projections 32 along sides walls 18, 20 (see FIG. 2). It will be readily apparent to those skilled in the art, however, that the loops 46 could be located in the recesses 34 on sidewalls 18, 20 with the posts 42 on the projections 32 along sidewalls 16, 22. Slots 46 are formed in the sidewalls 18, 20 to accommodate the coupling loop 40 which must necessarily pass through the sidewalls 18, 20 to engage the posts 42 (see FIGS. 2 and 6).

Figure 8:
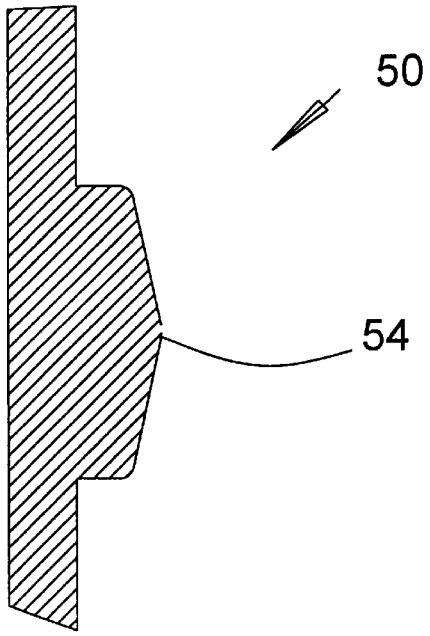
FIG. 8 is a section view of a retainer clip.
Figure 9:
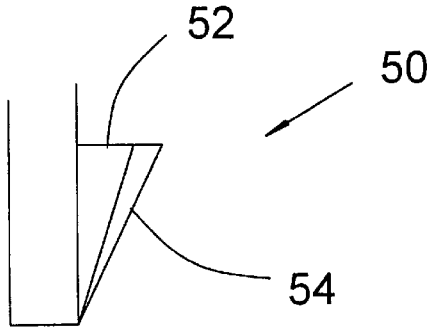
FIG. 9 is a side elevation view of the retainer clip.

A locking mechanism prevents the tiles 10 from lifting after they have been joined. In the disclosed embodiment, the locking mechanism comprises a retainer clip 50 formed on the projections 32 along sidewalls 18, 20 and corresponding notches 56 along sidewalls 16, 22. The retainer clip 50 is shown in more detail in FIGS. 8 and 9. The retainer clip 50 comprises a tab having a flat upper surface 52 and a beveled side surface 54. The flat upper surface 52 is adapted to engage with the notch 56 along sidewalls 16, 22. When the tiles 10 are being joined, the beveled sides 54 of the retainer clip 50 contacts the sidewall of the adjacent tile and flexes inwardly. When the retainer clip aligns with the notch 56 in the adjacent tile 10, the retainer clip 50 returns to its natural locking position. In this position, the top 54 of the retainer clip 50 engages the lower edge of the notch 56 in the adjacent tile to lock the tiles 10 in place.

In use, the floor tiles 10 of the present invention are installed over an underlying support surface. The floor tiles 10 may be installed over an existing floor which is worn or in need of repair. The floor tiles 10 are joined to one another by interlocking the coupling loops 40 on one tile 10 with the posts 42 on an adjacent tile 10 in the manner previously described. It is not necessary to anchor the floor tiles 10 to the underlying support surface. A playing surface is constructed by simply interlocking the tiles 10.

Once the playing surface is in place, it provides a consistent resilient surface with good impact absorption characteristics. Due to the flexibility of the tile 10, it is possible to accommodate some surface irregularities in the underlying support surface. However, "dead" spots in the playing surface may occur if the underlying support surface is too uneven so that a large number of support nodes 70 fail to contact the underlying support surface. After the floor tiles 10 are installed, lines can be painted on the top surface of the tile 10 as needed.

By using a two-piece construction to make the floor tiles 10 of the present invention, it is possible to select a suitable material for the top member 12 which will readily accept paint without the paint peeling, and which will be resistant to scuffing. As mentioned earlier, such materials generally lack the impact absorption characteristics needed for floor tiles 10. However, with the present invention, a different material can be selected for the support member 60 to provide the desired impact absorption characteristics.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A modular floor tile comprising:

a. a top member including a generally flat top surface and a peripheral sidewall extending downward from the outer periphery of the top surface;

b. a support member made of a resilient, impact-absorbing material secured to an underside of said top member for supporting the top member in spaced relation to an underlying support surface; and c. a series of coupling loops extending outwardly from selected sidewalls of said top member; and d. a series of posts disposed along selected sidewalls for engaging said coupling loops on an adjacent tile to secure the tiles together in side-by-side relationship.

2. The modular floor tile according to claim 1 wherein said first interlock members comprise a series of coupling loops and wherein said second interlock members comprises a series of posts which are receivable in the coupling loops of an adjacent tile.

3. The modular floor system according to claim 2 further including locking means for locking adjacent tiles together.

4. The modular floor tile according to claim 3 wherein said locking means comprises a series of retaining clips formed on selected sidewalls of said tile and a series of notches formed on other selected sidewalls of said tile, wherein said retaining clips on one tile engage with said notches on an adjacent tile to lock adjacent tiles together.

5. The modular floor tile according to claim 1 wherein said support member includes a bottom surface and a plurality of ground-engaging support nodes extending downward from the bottom surface, said support nodes being spaced from one another so as to define an air circulation space between the bottom surface of the support member and the underlying support surface.

6. The modular floor tile according to claim 5 wherein each support node includes a relatively large base portion, and a relatively small ground-engaging portion.

7. The modular floor tile of claim 6 wherein said base portion of said support nodes includes a generally flat land which surrounds the ground-engaging portion.

8. A modular floor tile comprising:

a. a top member including a plurality of sidewalls, each said sidewall having alternating projections and recesses formed therein, said projections and recesses being arranged so that the projections and recesses on selected sidewalls of the tile mate with the projections and recesses on selected sidewalls of an adjacent tile when adjacent tiles are joined;

b. a support member made of a resilient, impact-absorbing material secured to an underside of said top member for supporting the top member in spaced relation to an underlying support surface; and c. a series of coupling loops located in the recesses along selected sidewalls of said top member; and d. a series of posts located on said projections along selected sidewalls for engaging said coupling loops on an adjacent tile to secure the tiles together in side-by-side relationship.

9. The modular floor tile according to claim 8 wherein said first interlock members comprise a series of coupling loops and wherein said second interlock members comprise a series of posts which are receivable in the coupling loops of an adjacent tile.

10. The modular floor tile according to claim 9 further including locking means for locking adjacent tiles together.

11. The modular floor tile according to claim 10 wherein said locking means comprises a series of retaining clips formed on selected sidewalls of said tile and a series of notches formed on other selected sidewalls of said tile, wherein said retaining clips on one tile engage with said notches on an adjacent tile to lock adjacent tiles together.

12. The modular floor tile according to claim 8 wherein said support member includes a bottom surface and a plurality of ground-engaging support nodes extending downward from the bottom surface, said support nodes being spaced from one another so as to define an air circulation space between the bottom surface of the support member and the underlying support surface.

13. The modular floor tile according to claim 12 wherein each support node includes a relatively large base portion, and a relatively small ground-engaging portion.

14. The modular floor tile of claim 13 wherein said base portion of said support nodes includes a generally flat land which surrounds the ground-engaging portion.

15. A modular floor tile comprising:

a. a top member including a plurality of sidewalls, each sidewall having a plurality of alternating projections and recesses, wherein the projections and recesses on a first set of selected sidewalls complement the projections and recesses on a second set of sidewalls to allow mating of adjacent tiles when the tiles are disposed in side-by-side relationship;

b. a support member made of a resilient, impact-absorbing material secured to an underside of said top member for supporting the top member in spaced relation to an underlying support surface said support member including a bottom surface;

c. a plurality of support nodes projecting downward from the bottom surface of said support member, said support nodes being spaced from one another so as to define an air circulation space between the bottom surface of the support member and the underlying support surface.

d. a series of coupling loops extending outwardly from selected sidewalls of said top member; and e. a series of posts disposed along selected sidewalls for engaging said coupling loops on an adjacent tile to secure the tiles together in side-by-side relationship.

16. The modular floor tile of claim 15 further including means for interlocking adjacent tiles.

17. The modular floor tile of claim 16 wherein said interlocking means comprises a plurality of first and second interlock members located along selected sidewalls of said tile, wherein the first interlock members on one tile engage with the second interlock members on an adjacent tile to secure adjacent tiles together.

18. The modular floor tile according to claim 17 wherein said first interlock members comprise a series of coupling loops and wherein said second interlock members comprise a series of posts which are receivable in the coupling loops of an adjacent tile.

19. The modular floor tile according to claim 18 further including locking means for locking adjacent tiles together.

20. The modular floor tile according to claim 19 wherein said locking means comprises a series of retaining clips formed on selected sidewalls of said tile and a series of notches formed on other selected sidewalls of said tile, wherein said retaining clips of one tile engage with said notches on an adjacent tiles to lock adjacent tiles together.

21. The modular floor tile according to claim 20 wherein each support node includes a relatively large base portion, and a relatively small ground-engaging portion.

22. The modular floor tile of claim 21 wherein said base portion of said support nodes includes a generally flat land which surrounds the ground-engaging portion.

23. A modular floor tile comprising:

a. a top member having a generally flat top surface and a plurality of sidewalls defining a cavity on the underside of said top member;

b. a generally planar support member made of a resilient, impact-absorbing material adapted to fit into the cavity on the underside of said top member for supporting the top member in spaced relation to an underlying support surface; and c. a plurality of connectors for joining said tile to an adjacent tile.

24. The floor tile according to claim 23 further including a plurality of mating recesses and projections formed in said sidewalls.

25. The floor tile according to claim 24 wherein said connectors include first and second interlock members located along selected sidewalls and arranged such that the first interlock members on one tile engage with the second interlock members on an adjacent tile to secure adjacent tiles together in side-by-side relationship.

26. The floor tile according to claim 25 wherein said first interlock members comprise a series of coupling loops extending outwardly from selected sidewalls of said top member; and wherein said second interlock members comprise a series of posts disposed along selected sidewalls for engaging said coupling loops on an adjacent tile.

27. The floor tile according to claim 23 wherein said support member includes a bottom surface and a plurality of spaced-apart support nodes extending downward from said bottom surface to create an air circulation space between said bottom surface of said support member and an underlying support surface.

28. The floor tile according to claim 23 wherein said support member includes a top portion and a bottom portion, wherein said top portion is slightly smaller than said bottom portion so as to define a ledge that surrounds said top portion.

29. The floor tile according to claim 28 wherein said top portion is sized and shaped to fit into said cavity in said top member with the sidewalls of said to member supported by said ledge.

30. A modular floor tile for constructing athletic playing surfaces comprising:

a. a top surface;

b. sidewalls extending down from said top surface having alternating projections and recesses formed therein, said projections and recesses being arranged so that the projections and recesses on selected sidewalls of the tile mate with the projections and recesses on selected sidewalls of an adjacent tile when adjacent tiles are joined;

c. a series of first coupling members located in the recesses along selected sidewalls of said top member; and d. a series of second coupling on said projections along selected sidewalls for engaging said first coupling members on an adjacent tile to secure the tiles together in side-by-side relationship.

* * * * *